US007958918B2

(12) United States Patent
Ladson

(10) Patent No.: US 7,958,918 B2
(45) Date of Patent: Jun. 14, 2011

(54) AUTOMATED ICE VENDING APPARATUS AND METHOD

(76) Inventor: Jon Ladson, Moultrie, GA (US)

( * ) Notice: Subject to any disclaimer, the term of this patent is extended or adjusted under 35 U.S.C. 154(b) by 989 days.

(21) Appl. No.: 11/732,766

(22) Filed: Apr. 4, 2007

(65) Prior Publication Data

US 2008/0245438 A1 Oct. 9, 2008

(51) Int. Cl.
*B65B 1/04* (2006.01)

(52) U.S. Cl. ..... 141/114; 141/10; 141/82; 141/314; 222/146.6; 222/254

(58) Field of Classification Search ..... 141/10, 141/82, 98, 114, 313–317; 222/146.6, 254
See application file for complete search history.

(56) References Cited

U.S. PATENT DOCUMENTS

| | | | | |
|---|---|---|---|---|
| 3,495,378 | A | 2/1970 | Kipers | |
| 3,807,193 | A | 4/1974 | McKenney et al. | |
| 4,368,608 | A | 1/1983 | Ray | |
| 4,689,937 | A | 9/1987 | Finan, Sr. et al. | |
| 5,088,300 | A * | 2/1992 | Wessa | 62/340 |
| 5,277,016 | A | 1/1994 | Williams et al. | |
| 5,442,898 | A | 8/1995 | Gabree et al. | |
| 5,457,944 | A | 10/1995 | Lipes | |
| 5,458,851 | A | 10/1995 | Schroeder et al. | |
| 5,630,310 | A * | 5/1997 | Chadwell | 53/502 |
| 5,771,717 | A | 6/1998 | Broker et al. | |
| 6,035,606 | A | 3/2000 | Bussey, III et al. | |
| 6,112,539 | A | 9/2000 | Colberg | |
| 6,474,048 | B1 * | 11/2002 | Metzger et al. | 53/493 |
| 6,516,587 | B1 | 2/2003 | Chikatani | |
| 6,588,666 | B1 | 7/2003 | Sacchetti et al. | |
| 6,860,408 | B2 * | 3/2005 | Hawkes | 222/146.6 |
| 6,904,946 | B2 * | 6/2005 | James | 141/313 |
| 6,931,817 | B2 | 8/2005 | Reed | |
| 6,932,124 | B2 | 8/2005 | Dalton et al. | |
| 7,104,291 | B2 | 9/2006 | Dalton et al. | |
| 7,207,156 | B2 * | 4/2007 | Metzger | 53/440 |
| 7,421,834 | B1 * | 9/2008 | Doolan | 222/452 |
| 7,426,812 | B2 * | 9/2008 | Metzger | 53/459 |
| 7,426,945 | B2 * | 9/2008 | Dalton et al. | 141/82 |
| 7,497,062 | B2 * | 3/2009 | Metzger | 53/58 |
| 7,681,408 | B2 * | 3/2010 | Hobson et al. | 222/412 |
| 7,735,527 | B2 * | 6/2010 | Dunn | 141/82 |
| 2003/0168321 | A1 | 9/2003 | Kato et al. | |
| 2004/0140178 | A1 | 7/2004 | Wiejack-Symann et al. | |
| 2006/0174969 | A1 | 8/2006 | Dalton et al. | |
| 2006/0283146 | A1 | 12/2006 | Kawakami | |
| 2007/0017187 | A1 | 1/2007 | Chikatani | |

* cited by examiner

*Primary Examiner* — Gregory L Huson
*Assistant Examiner* — Nicolas A Arnett
(74) *Attorney, Agent, or Firm* — Williamson Intellectual Property Law, LLC; Thomas R. Williamson, III

(57) ABSTRACT

An automated ice vending apparatus and method including an ice generating machine capable of producing enough ice to sufficiently keep full a receptacle positioned beneath the ice generating machine, a first ice moving device with cutting members positioned within the receptacle to move ice from the receptacle to a second ice moving device, wherein the ice is subsequently transferred to a removable container.

19 Claims, 4 Drawing Sheets

AUTOMATED ICE VENDING APPARATUS AND METHOD

FIELD OF INVENTION

The present invention relates to an ice vending apparatus, and more specifically to an automated ice vending apparatus and a method of use therefor, wherein ice is produced and automatically transported to a removable container.

DESCRIPTION OF RELATED ART

There are various types of ice bagging and ice vending machines. One such device discloses a method for automatically bagging ice using a multi-positional electronic scale. Ice is delivered into a bag until signaled by a sensor that indicates by weight that the bag is full. The bag is then heat sealed and the scale rotates allowing a new bag to be filled.

Another previous device discloses an automatic ice bagger which freezes a measured amount of water in a cubed tray. The ice is then dropped into an awaiting bag, which is subsequently heat sealed, and deposited in an awaiting freezer.

Another device discloses an article bagging unit which partially opens a bag with a blower and then fully opens the bag with two pairs of fingers before depositing articles within the bag.

Another device teaches a method and apparatus for opening, filling and closing a pre-made wicketed bag in which air is guided into the bag to partially open the bag, wherein a pivotable plate holds the bag open for filling.

Yet another device discloses an automated ice bagging apparatus and method wherein ice is generated and transported to a weighing station before being bagged.

Due to the constraints of the current machines, the typical manner in which a consumer gets bagged ice pieces such as cubes, particles, or the like, still remains the picking up of a bag of ice which has been delivered by a truck to an awaiting freezer. This is cost effective neither to the wholesale distributor nor the retail seller and can frustrate the end consumer when the freezer becomes empty and has not been refilled. Further, the transportation of ice and moving of ice to separate freezers can allow the ice to begin to thaw, and then when the ice refreezes it forms clumps which are undesirable to the consumer. The prolonged exposure of the bags of ice to the freezer can cause further clumping or staleness of the ice. Thus, currently existing devices in the field of automated ice generating and bagging are disadvantageous by not providing a cost effective way to produce bagged ice onsite.

Current machines which provide onsite manufacturing or bagging also tend to allow the ice pieces to adhere to each other forming ice clumps which must be manually removed from the machines, which take up an unnecessary amount of space, and/or which risk clogging the machinery, thereby causing it to malfunction. As an alternative some existing onsite manufacturing or bagging machines require the use of a second device to break up the ice and help transport the ice pieces. The extra devices within the current onsite manufacturing or bagging machines result in higher manufacturing costs and also provide more components which can malfunction, leading to lost efficiency and profits.

Further, when ice is moved inefficiently from a storage tank of an onsite ice manufacturing or bagging machine it can allow old ice to collect within the storage tanks. This can promote further clumping and cause the ice to become stale and less desirable for the consumer.

Some of the current onsite ice manufacturing or bagging machines also allow for heat sealing of the bags which leads to a risk of partial melting of the ice particles which then refreeze during storage, forcing the consumer to break apart the ice. Often such attempts to break apart the clumps of ice particles can lead to tears in the bags containing the ice, resulting in lost ice and contamination of the ice within the bags.

Therefore, it is readily apparent that there is a need for an automated ice vending apparatus and method which minimizes these deficiencies by providing onsite freshly bagged ice which has neither formed into clumps nor become stale. This would serve the functions of reducing cost, time, inefficiencies, and the complexity and number of machinery within the device, while providing maximum customer satisfaction through onsite provision of on demand, fresh, bagged ice.

SUMMARY OF THE INVENTION

Briefly described, in a preferred embodiment, the present invention overcomes the above-mentioned disadvantages and meets the recognized need for such a mechanism by providing an efficient automated ice vending apparatus and method of use thereof.

The present invention comprises an automated ice vending apparatus comprising an ice generating machine with a receptacle positioned to receive ice from the ice generating machine, an ice transferring mechanism with attached cutting members which transfers the ice to a removable container for a predetermined amount of time until the removable container is sufficiently full of ice. Having cutting members located on the ice transferring mechanism cuts apart any clumping in the ice, resulting in ice that is easier to move throughout the apparatus, easier to place into a removable container, and is more desirable to the consumer.

In a further embodiment, the cutting members are positioned such that they project into the receptacle through channels on the floor or lower portion of the receptacle, thereby allowing the cutting members to move the ice while not allowing the ice to fall beneath the floor or lower portion of the receptacle, resulting in less lost ice, better efficiency, and saved resources.

In another embodiment, the first ice moving mechanism of the automated ice vending apparatus may comprise a conveyor belt, a pull chain mechanism, a plurality of side-by-side rollers, a continuously operable loop, any combination thereof, or any other suitable means for transferring the ice through the receptacle.

In yet a further embodiment, the first ice moving mechanism moves the ice through an aperture of the receptacle, wherein the ice is then moved to the removable container via a second ice moving mechanism. The second ice moving mechanism moves the ice to a third ice moving mechanism, which is selectively inclined, wherein the third ice moving mechanism moves the ice to the removable container. Both the second ice moving mechanism and the third ice moving mechanism could comprise an auger, a series of scoops on a belt, a series of scoops on a chain, a conveyor belt, any combination thereof, or any other known mechanism for moving ice.

In still another embodiment of the automated ice vending apparatus, the removable container is a bag. The bag is urged open by a burst of air from a blower or compressor. Those skilled in the art would recognize that any form of pressurized gas may be used and the present invention is not limited only to blowers or compressors. The bag is subsequently held open by a bag flap while ice is dispensed into the bag. The bag is then optionally sealed via any means known in the art, for example, but not limited to, heat sealing, ties, staples, and/or twisting, wherein sealing may alternatively be done internally by selected mechanisms or externally by a consumer. The bags may optionally be of sufficient size to not require automatic sealing, wherein the consumer has the option of sealing the bag by any means known.

In another preferred embodiment, the removable container rests on a movable platform while receiving ice. After a designated period of time, which is determined by, or preset into, a programmable logic controller, the movable platform is withdrawn from beneath the removable container and the removable container is thus free to fall to a final ice receptacle, where it is removed. The final ice receptacle has a lockable door to prevent access to the removable container within the final ice receptacle until the desired time.

In one preferred embodiment, the automated ice vending apparatus comprises an ice supply, a first receptacle positioned to receive ice from the ice supply, a first ice moving mechanism within the first receptacle positioned to move ice through an aperture of the first receptacle, cutting members positioned on the first ice moving mechanism, a second receptacle positioned to receive ice from the first receptacle, a second ice moving mechanism positioned to move ice through the second receptacle, a third ice moving mechanism positioned to receive ice from the second ice moving mechanism, and a removable container positioned to receive ice from the third ice moving mechanism. The first ice moving mechanism, second ice moving mechanism, and third ice moving mechanism operate for a predetermined amount of time, wherein the predetermined amount of time is determined by a programmable logic controller, wherein the first ice moving mechanism moves ice to the second ice moving mechanism and the second ice moving mechanism moves ice to the third ice moving mechanism which moves ice to the removable container that is filled to a selected level by the predetermined amount of time.

In another embodiment, the automated ice vending apparatus requires a form of payment before ice is delivered to the consumer. Any known forms of payment may be accepted including, but not limited to monetary coins, monetary bills, cards, checks, tokens, computer chips which signify money, biometrics, electrical, and/or magnetic, as well as future forms of payment. A consumer pays for a selected quantity of ice, wherein the programmable logic controller operates for a time determined by the user's selection, thereby providing the proper quantity of ice in the removable container.

In use, ice is provided to a first receptacle, wherein ice is moved to a removable container by cutting blades attached to a first ice moving mechanism, and wherein the ice is received by the removable container. In a further use, the ice is preferably moved by the first ice moving mechanism to a second receptacle position, wherein a second ice moving mechanism moves the ice to a third ice moving mechanism which in turn moves the ice to a removable container.

According to its major aspects and broadly stated, the present invention in its preferred form is an automated ice vending apparatus comprising an ice supply, a first receptacle positioned to receive ice from the ice supply, wherein the floor of the first receptacle has elongated apertures disposed through which ice cutting members protrude, and wherein the ice cutting members are moved substantially the length of the apertures in the first receptacle by a pull chain positioned to run substantially parallel to and within the apertures. Once the ice is cut apart by the cutting members, the ice is pushed off of the floor of the first receptacle into a second receptacle which contains a substantially horizontal auger positioned to move the ice along a substantially horizontal line to an inclined auger. The inclined auger transports the ice from the substantially horizontal auger to a bag, wherein the bag has been partially urged open by a blower, which discharges air in the direction of the bag, and wherein the bag is held open by a bag flap which is movably positioned to secure the bag once the bag is blown open. Ice then falls into the bag which is held open by the bag flap for an amount of time predetermined by a programmable logic controller, thus filling the bag to a desired level. Once the bag has been filled for a predetermined amount of time, the programmable logic controller stops the ice moving mechanisms, the bag flap releases the bag and a removable support which has thus far been positioned underneath the bag is removed allowing the bag containing the desired amount of ice to fall to a receiving area where it is available for pick up by a consumer.

More specifically, the present invention is an automated ice vending apparatus preferably comprising an ice supply and a first receptacle, wherein the first receptacle is preferably positioned to receive ice from the ice supply. The ice supply may have ice delivered within, but preferably the ice supply generates ice. It will be recognized by those skilled in the art that any refrigeration/ice making equipment could be utilized to make ice. The first receptacle comprises a refrigerated or insulated substantially enclosed space comprising a floor, wherein the floor comprises at least one elongated aperture substantially running the length of the floor. Additional support may be provided to the floor by any means necessary to support the weight of the ice. A plurality of cutting members preferably protrude through the apertures in the floor, wherein the plurality of cutting members are secured to the first ice moving mechanism. The first ice moving mechanism preferably comprises, but is not limited to at least one pull chain mechanism operating in an infinite loop, but may also comprise any mechanism suited to move the cutting members along the elongated apertures in the floor. Any clumps or chunks of ice are thus separated by the cutting members as the ice is transported along the floor by the first ice moving mechanism through the apertures in the first ice receptacle to a second ice receptacle, wherein the second ice receptacle is positioned to receive the ice from the first ice moving mechanism. The second ice moving mechanism is positioned within the second ice receptacle to move the ice to the third ice moving mechanism. The second ice moving mechanism is preferably a substantially horizontal auger, although other means of moving ice are contemplated by the inventor. The third ice moving mechanism is preferably a substantially inclined auger positioned to receive ice from the second ice moving mechanism and transport the ice to a removable container. The first ice moving mechanism, second ice moving mechanism, and third ice moving mechanism are preferably moved by at least one motor.

Ice is transferred from its storage area in the first receptacle to a removable container, such as a bag. An air compressor forces air through an air tube to urge the bag open. It will be recognized by those skilled in the art that any form of compressed or flowing gas may be used to urge open the bag, thus the present invention is not limited to compressors and blowers. Once the bag is partially opened, the bag flap, which is movably positioned, is activated by the bag flap cylinder, further opening the bag and securing the bag while ice is received within the bag.

The removable container is supported by a movable platform, wherein the movable platform is preferably withdrawn from beneath the removable container by a removable door cylinder after a programmable logic controller determines adequate time has passed, thus allowing the removable container with the selected quantity of ice therewithin to fall to the final ice receptacle where it is made available to the consumer. The amount of time for which the programmable logic controller operates the ice moving mechanisms is preferably dependant upon the amount of ice requested by the consumer.

Accordingly, a feature and advantage of the present invention is its ability to separate clumps of ice which may have formed during the storage period thereby saving, time, money and space, and preventing damage to the machinery, Another feature and advantage of the present invention is to produce bagged ice near on-demand, reducing the frustration of consumers and providing extra convenience as well as reducing costs.

Yet another feature and advantage of the present invention is to provide fresh ice in a more cost efficient manner.

Yet another feature and advantage of the present invention is its ability to accept multiple forms of payment.

Yet still another feature and advantage of the present invention is its ability to provide selected quantities of ice.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Selected Alternate Embodiments with reference to the accompanying drawing figures, in which like reference numerals denote similar structure and refer to the elements throughout, and in which.

DETAILED DESCRIPTION OF THE PREFERRED AND SELECTED ALTERNATE EMBODIMENTS

Figure 1:
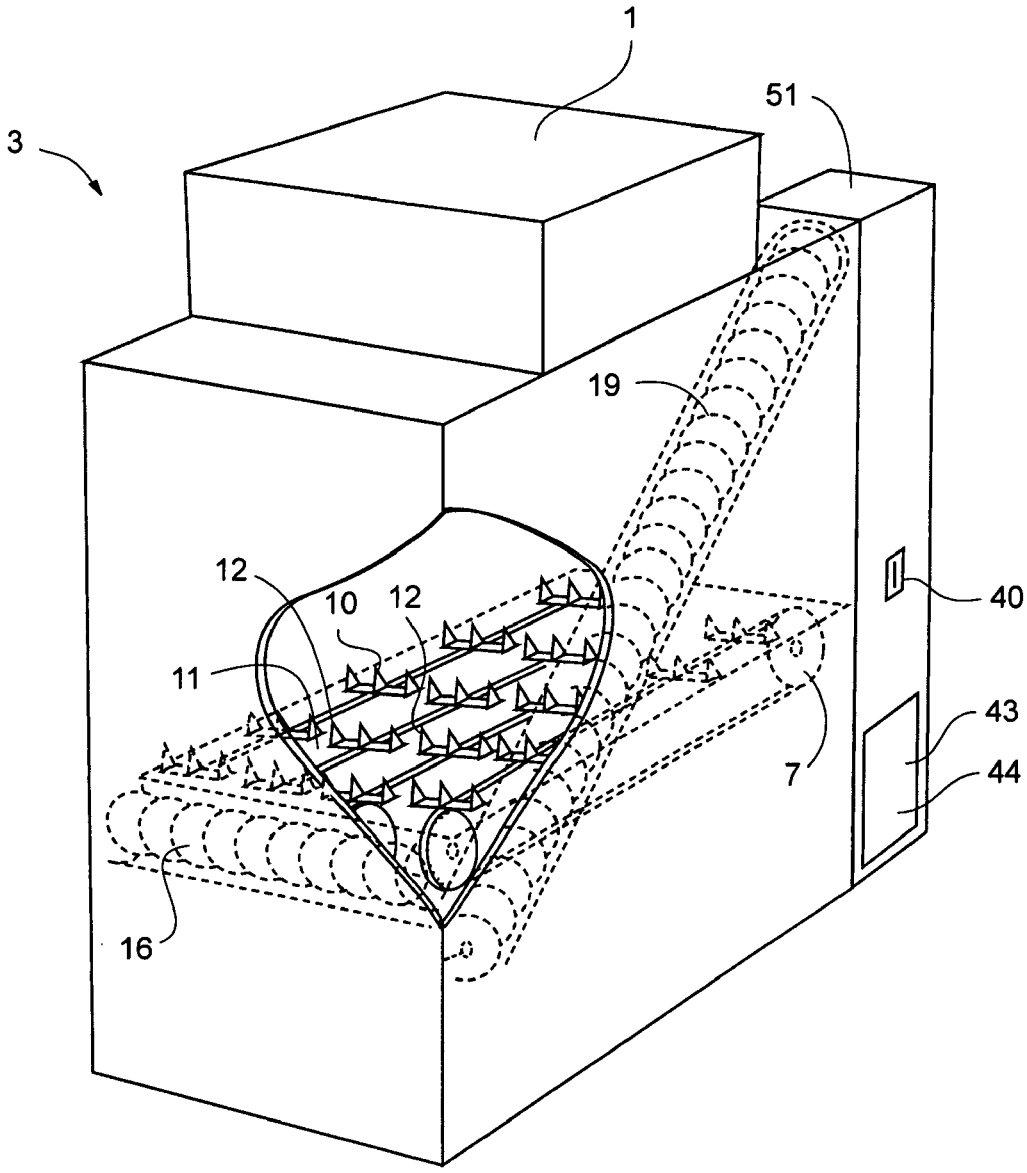
FIG. 1 depicts a partial cutaway perspective view of a preferred embodiment.

In describing the preferred and selected alternate embodiments of the present invention, as illustrated in FIGS. 1-5, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIG. 1-5, the present invention in a preferred embodiment comprises automated ice vending apparatus 3. Automated ice vending apparatus 3 preferably comprises ice supply 1 and first receptacle 4 having first ice moving mechanism 7 therewithin, wherein first receptacle 4 is preferably positioned to receive ice 2 from ice supply 1. Ice supply 1 may have ice 2 delivered within, but preferably ice supply 1 generates ice 2. It will be recognized by those skilled in the art that any refrigeration/ice making equipment could be utilized to make ice.

First receptacle 4 preferably comprises a refrigerated or insulated substantially enclosed space comprising floor 11, wherein floor 11 preferably comprises at least one elongated aperture 12 preferably running the length of floor 11. Additional support may be provided to floor 11 by any means necessary to support weight of ice 2, as such is known in the art. Plurality of cutting members 10 preferably protrude through apertures 12 of floor 11, wherein plurality of cutting members 10 are preferably secured to first ice moving mechanism 7. First ice moving mechanism 7 preferably comprises, but is not limited to, at least one pull chain mechanism operating in an infinite loop, but may also comprise any mechanism suited to move cutting members 10 along elongated apertures 12 of floor 11. First ice moving mechanism 7 is preferably moved by motor 15. Any clumps or chunks of ice 2 are thus separated by cutting members 10 as ice 2 is transported along floor 11 by first ice moving mechanism 7 through aperture in first ice receptacle 4 to second ice receptacle 13, wherein second ice receptacle 13 is preferably positioned to receive ice 2 from first ice moving mechanism 7.

Second ice moving mechanism 16 is preferably positioned within second ice receptacle 13 to move ice 2 to third ice moving mechanism 19. Second ice moving mechanism 16 is preferably a substantially horizontal auger, although any mechanism suitable for moving ice 2, such as for exemplary purposes only and not meant to be limiting, series of scoops on a belt, series of scoops on a chain, conveyor belt, any combination thereof, or any other known mechanism for moving ice.

Second ice moving mechanism 16 is preferably also moved by motor 15, wherein second ice moving mechanism 16 is preferably moved by belt 17 connected to first ice moving mechanism 7. Third ice moving mechanism 19 is preferably moved by motor 18. One skilled in the art would realize first ice moving mechanism 7, second ice moving mechanism 16, and/or third ice moving mechanism 19 could be moved by its own motor or ice moving mechanisms 7, 16, 19 could be moved with any combination of motors, wherein motors are preferably electric, but may also comprise any type of motor known, and wherein motors 15, 18, are preferably located outside of outer housing 49 to prevent heat from motors 15, 18, from reaching ice 2, but may also be located within outer housing 49. Third ice moving mechanism 19 is preferably a substantially inclined auger, although any mechanism suitable for moving ice 2, such as for exemplary purposes only and not meant to be limiting, series of scoops on a belt, series of scoops on a chain, conveyor belt, any combination thereof, or any other known mechanism for moving ice. First ice moving mechanism 7, first ice receptacle 4, ice supply 1, second ice moving mechanism 16, second ice receptacle, motors 15, 18, and third ice moving mechanism 19 are preferably substantially supported by base 8.

Still referring to FIGS. 1-5, in a preferred embodiment of automated ice vending apparatus 3, ice 2 is transported by third ice moving mechanism 19 wherein ice 2 preferably falls into a removable container 22. Removable container 22 may comprise any vessel useful for transporting goods including, but not limited to buckets, rigid and non-rigid containers, or boxes, but preferably removable container 22 comprises, for exemplary purposes only, bags 23, wherein bags 23 preferably comprise non-rigid material forming enclosing sides and bottom with an open top. One skilled in the art would realize bags 23 may also be formed by overlapping sheets, wherein sheets are sealed on three sides, leaving one end open. Automated ice vending apparatus 3, shown in a preferred embodiment, comprises air compressor 25 which forces air through air compressor tube 26 urging bag 23 open. It will be recognized by those skilled in the art that any form of compressed or flowing gas may be used to urge open bag 23, thus the present invention is not limited to compressors 25 and blowers 25. Once bag 23 is partially opened, bag flap 28, which is movably positioned, is activated by bag flap cylinder 31 further opening bag 23 and securing bag 23 while ice 2 is received within bag 23.

Figure 4:
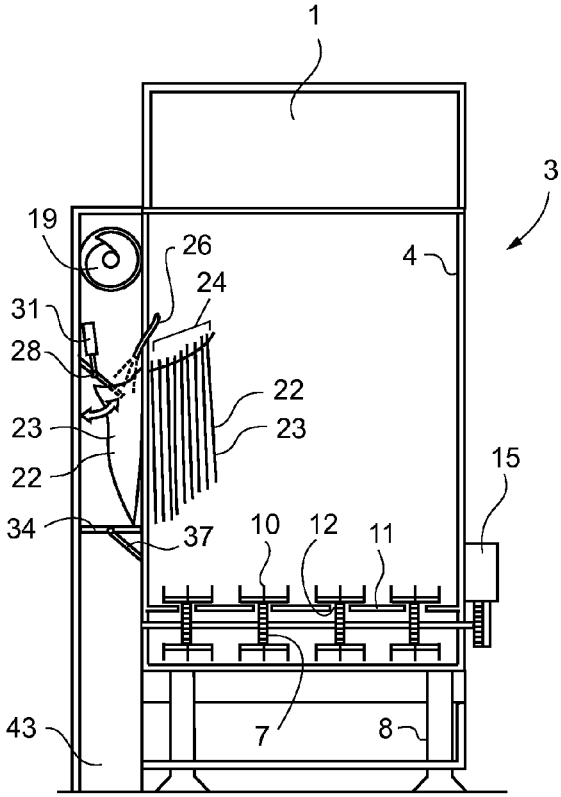
FIG. 4 depicts a partial cross-section elevated right view of a preferred embodiment.
Figure 5:
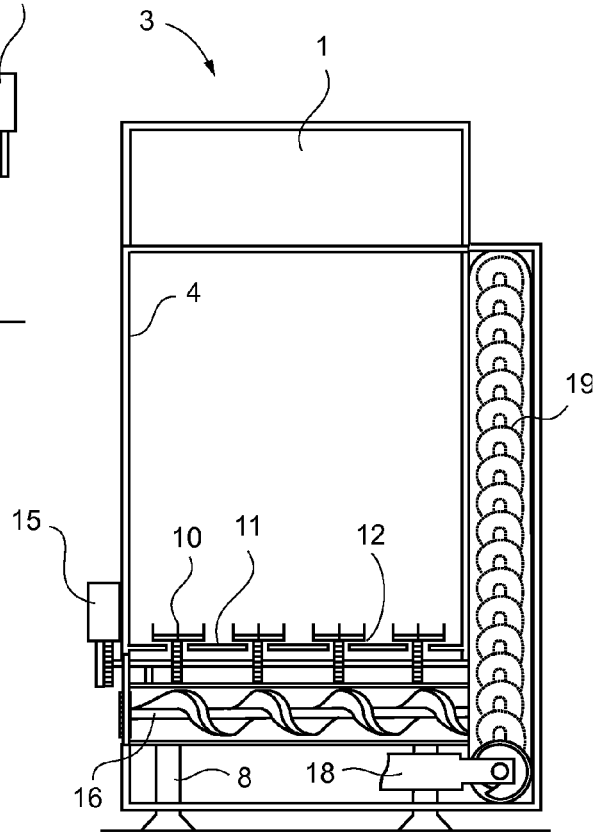
FIG. 5 shows a partial cross-section elevated left view of a preferred embodiment.

In a preferred embodiment, bags 23 may be provided one at a time, but may preferably be stored as plurality of bags 24 as shown in FIG. 4, thus reducing the need to manually add bags to ice vending apparatus 3.

In another preferred embodiment represented in FIGS. 1-5 removable container 22 is supported by movable platform 34, wherein movable platform 34 is preferably withdrawn from beneath removable container 22 by movable platform cylinder 37 after programmable logic controller 46 determines adequate time has passed the selected quantity of ice 2. Once programmable logic controller 46 determines adequate time has passed, all motors 15, 18 are stopped, thus stopping ice 2 from continuing to fill removable container 22, bag flap cylinder 31 raises bag flap 28, and movable platform 34 is withdrawn, allowing removable container 22 with selected quantity of ice therewithin to fall to final ice receptacle 43 where it is made available to consumer.

In yet another preferred embodiment programmable logic controller 46 is only activated after payment is received through vending apparatus 40, wherein activation starts motors 15, 18. Motors 15, 18 in turn start first ice moving mechanism 7, second ice moving mechanism 16, third ice moving mechanism 19, air compressor 25, and bag flap cylinder 31 to move bag flap 28. Any amount or form of payment may be received by vending apparatus 40 such as, for exemplary purposes only and not limiting, all known methods of payment, including, monetary coins, monetary bills, checks, cards, magnetic strips, tokens, or any electrical, computer chip controlled or biometric mechanism for receiving payment.

In a preferred embodiment, consumer is given the option of selecting how much ice 2 is desired, paying an amount in accordance with said selected quantity, where programmable logic controller operates ice vending apparatus, thus providing ice for a period of time determined by quantity of ice 2 desired and paid for by consumer.

In still another preferred embodiment, ice 2 within removable container 22 is provided to consumer without being sealed. In this preferred embodiment, means for sealing the removable container 22 may preferably be provided to consumer so that removable container 22 may be sealed by consumer if so desired. However, removable container 22 may also be sealed within ice vending apparatus 3 by any means known, for example, but not limited to, heat sealing, ties, staples, and/or twisting.

Figure 2:
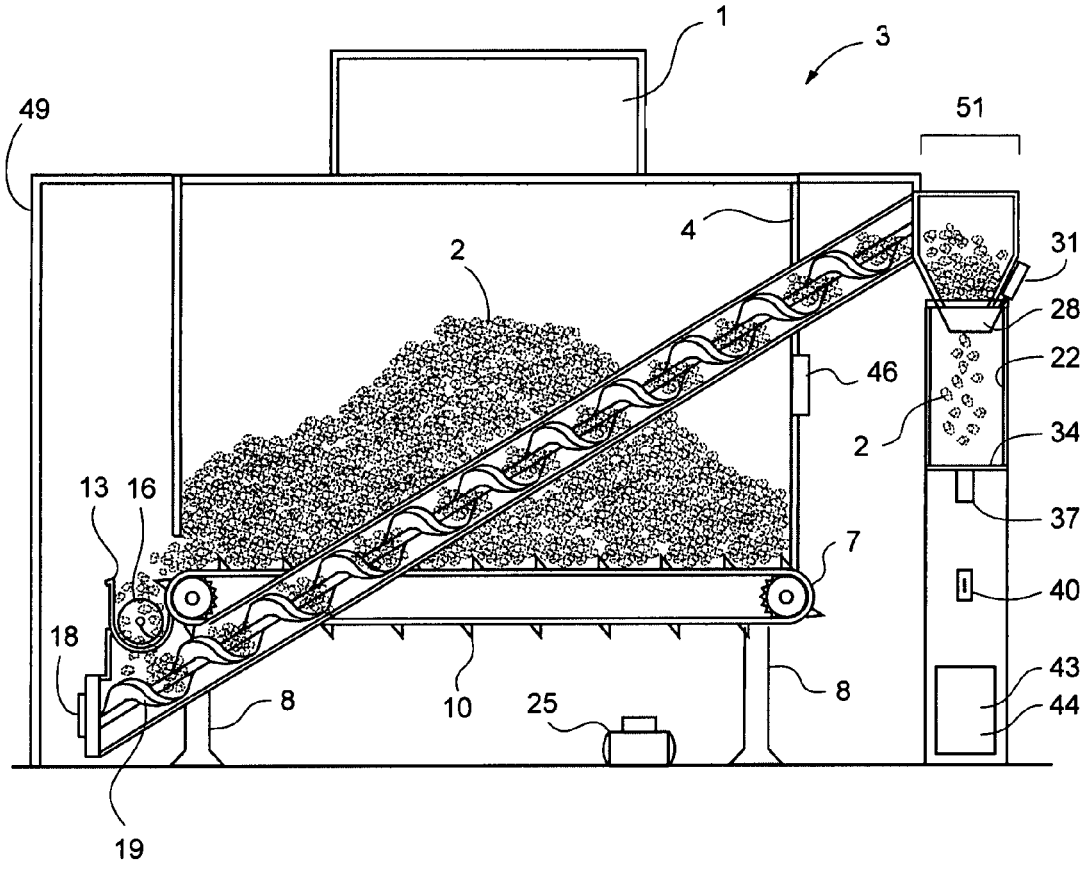
FIG. 2 shows a partial cross section front elevation view of a preferred embodiment.

In another preferred embodiment, as referred to in FIGS. 1 and 2, the final ice receptacle comprises door 44 which preferably may only be moved once removable container 22 is available.

Figure 3:
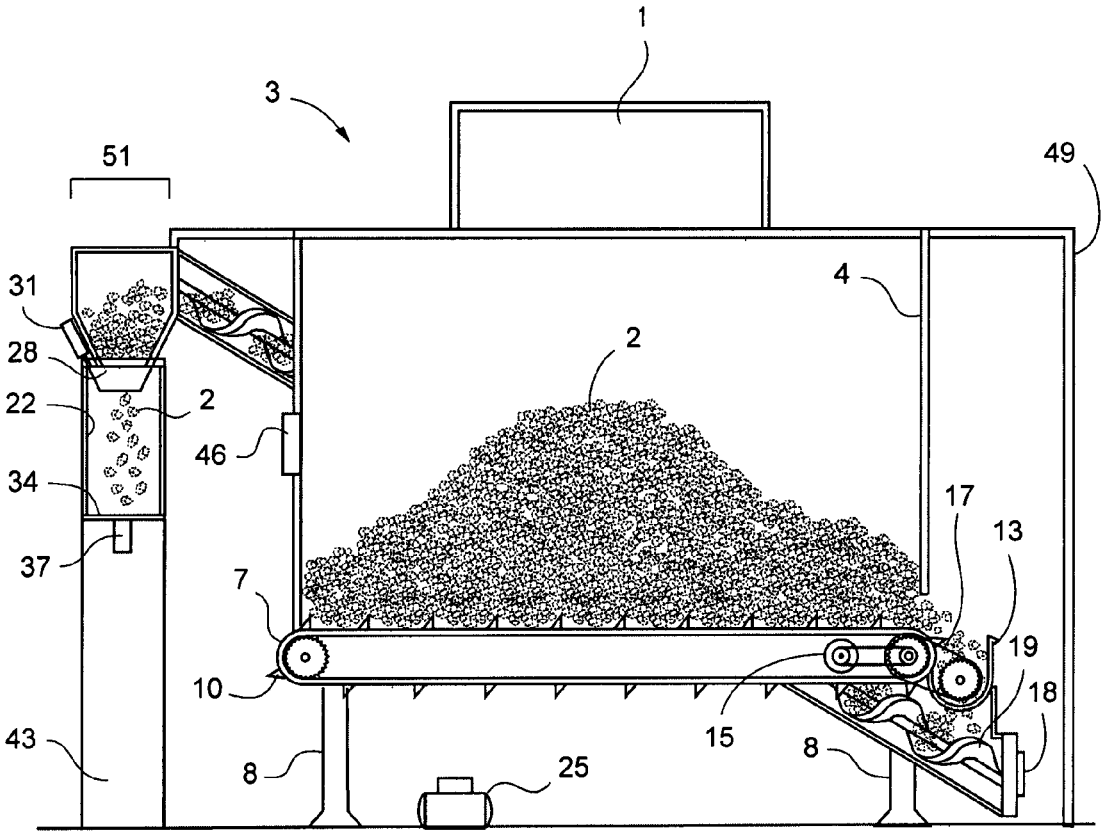
FIG. 3 shows a partial cross section elevated rear view of a preferred embodiment.

FIGS. 2-4 show an embodiment of ice vending apparatus 3 in which vending component 51 is separated from first ice receptacle 4, however FIG. 1 shows a preferred embodiment wherein the space between vending component 51 and first ice receptacle is reduced thus reducing the amount of space within outer housing 49, and thusly reducing the amount of space which must be cooled to prevent melting of ice 2.

In an alternate embodiment an option may be selected to allow ice 2 to fall directly to final ice receptacle 43, thereby bypassing removable container 22, and thus allowing for easier filling of external containers (not shown) In this embodiment, programmable logic controller 46 does not activate air compressor 25, bag flap cylinder 31, or bag flap 28 and automatically withdraws movable platform 34 by movable platform cylinder 37, thus allowing ice to fall directly to final ice receptacle 43. In a further embodiment of this design chute (not shown) may preferably be provided to allow ice 2 to be moved directly into external container (not shown).

In use, ice 2 may preferably be supplied to removable container 22 by moving ice 2 from first ice receptacle 4 to removable container 22, wherein ice 2 is broken or cut apart by cutting members 10 protruding through first ice receptacle 4. In a further use, ice 2 may preferably be transported by first ice moving mechanism 7 to second ice receptacle 13, wherein ice 2 is transferred to third ice moving mechanism 19 before being received by removable container 22. In still a further use, supply of ice 2 is controlled by programmable logic controller 46 which activates motors 15, 18 thereby moving ice 2. In yet a further use, ice 2 is collected in removable container 22 where removable container 22 is supported by movable platform 34 which may be withdrawn by movable platform cylinder 37, thereby allowing removable container 22 with ice 2 to fall to final ice receptacle 43 where it may be retrieved by consumer.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method if a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. An automated ice vending apparatus comprising:

an ice supply;

a removable container;

a receptacle positioned to receive ice from said ice supply, wherein said receptacle is disposed external to and proximate to said ice supply; and a first ice moving mechanism within said receptacle positioned to move ice to said removable container, wherein said first ice moving mechanism comprises cutting members positioned on a portion of said first ice moving mechanism, and wherein said first ice moving mechanism is disposed within elongated apertures within a floor portion of said receptacle.

2. The apparatus of claim 1, wherein said cutting members are positioned such that they project, and wherein said first ice moving mechanism is disposed within elongated apertures within a floor portion of said receptacle.

3. The apparatus of claim 1, wherein said first ice moving mechanism is selected from a group consisting of a conveyor belt, a pull chain mechanism, a plurality of side-by-side rollers, a continuously operable loop, and combination thereof.

4. The apparatus of claim 1, further comprising:

a second ice moving mechanism positioned to move ice from said first ice moving mechanism to said removable container.

5. The apparatus of claim 4, wherein said second ice moving mechanism is selected from a group consisting of an auger, a series of scoops on a belt, a series of scoops on a chain, and a conveyor belt.

6. The apparatus of claim 1, further comprising:

said first ice moving mechanism within said receptacle positioned to move ice through an aperture of said receptacle;

a second ice moving mechanism positioned to move ice from said first ice moving mechanism to a third ice moving mechanism, wherein said third ice moving mechanism is substantially inclined; and wherein said third ice moving mechanism is positioned to move ice to said removable container.

7. The apparatus of claim 6, wherein said third ice moving mechanism is selected from a group consisting of an auger, a series of scoops on a belt, a series of scoops on a chain, a conveyor belt, and combination thereof.

8. The apparatus of claim 1, wherein said removable container comprises a bag.

9. The apparatus of claim 8, wherein said bag is opened via a burst of air.

10. The apparatus of claim 8 further comprising a bag flap, wherein said bag flap is positioned to hold open said bag as ice enters said bag.

11. The apparatus of claim 1, wherein said removable container rests on a platform while receiving ice, and wherein said platform is selectively withdrawn to permit said removable container to fall into a final ice receptacle.

12. The apparatus of claim 11, wherein said platform is withdrawn after a designated period of time.

13. The apparatus of claim 12, wherein said designated period of time is determined by a programmable logic controller, and wherein a selected quantity of ice is loaded into said removable container for said designated period of time.

14. The apparatus of claim 13, wherein said final ice receptacle comprises an aperture covered by a movable door.

15. The apparatus of claim 1 further comprising a means for accepting payment, wherein said payment determines a quantity of ice delivered to said removable container.

16. An ice vendor automated apparatus, comprising:

an ice supply;

a first receptacle positioned to receive ice from said ice supply, wherein said first receptacle is external to and proximate to said ice supply;

a first ice moving mechanism disposed within elongated apertures in a floor portion of said first receptacle, wherein said first ice moving mechanism is positioned to move ice through an aperture of said first receptacle;

cutting members positioned on said first ice moving mechanism;

a second receptacle positioned to receive ice from said first receptacle;

a second ice moving mechanism positioned to move ice through said second receptacle;

a third ice moving mechanism positioned to receive ice from said second ice moving mechanism; and a removable container positioned to receive ice from said third ice moving mechanism.

17. A method for supplying contained ice which comprises:

providing ice to a first receptacle;

moving ice from said first receptacle to a removable container, wherein said moving step further comprises moving ice by a first ice moving mechanism comprising cutting members, wherein said first ice moving mechanism is disposed within elongated apertures in a floor portion of said first receptacle, and wherein said cutting members extend above said floor portion; and receiving ice in a removable container.

18. The method of claim 17 wherein said moving step further comprises the step of:

moving ice by said first ice moving mechanism to a second receptacle position, and moving ice from said second receptacle position to a third ice moving mechanism.

19. A system for vending comprising:

an ice supply;

a first receptacle positioned to receive ice from said ice supply, said first receptacle having elongated apertures disposed along a lower portion thereof;

a pull chain ice moving device positioned within said elongated apertures of said lower portion of said first receptacle;

cutting devices positioned on said pull chain ice moving device, wherein said cutting devices protrude above said elongated apertures of said lower portion of said first receptacle;

a second receptacle positioned to receive ice from an aperture in said first receptacle, wherein ice is moved to said second receptacle by said pull chain ice moving device;

a substantially horizontal auger positioned within said second receptacle, wherein said substantially horizontal auger moves ice;

an inclined auger positioned to receive ice from said substantially horizontal auger;

a bag positioned to receive ice from said inclined auger;

a blower positioned to discharge air urging said bag into an open position;

a bag flap movably positioned to hold open said bag;

a trap door movably positioned beneath said bag, wherein upon activation of said trap door, said bag falls therethrough;

a programmable logic controller programmed to move ice to said bag for a designated period of time and to activate said trap door; and a vending apparatus for receiving a payment, wherein said designated period of time is determined by quantity of said payment.

* * * * *